US007624548B2

(12) United States Patent
Hansen et al.

(10) Patent No.: US 7,624,548 B2
(45) Date of Patent: Dec. 1, 2009

(54) TEMPORARY CLOSURE

(76) Inventors: Søren Hansen, St. Valbyvej 201, Roskilde (DK) 4000; Lasse Fomsgaard Ramskov, Birkholmvej 27, Vanløse (DK) 2720

( * ) Notice: Subject to any disclaimer, the term of this patent is extended or adjusted under 35 U.S.C. 154(b) by 0 days.

(21) Appl. No.: 11/390,843

(22) Filed: Mar. 27, 2006

(65) Prior Publication Data

US 2006/0174561 A1 Aug. 10, 2006

Related U.S. Application Data

(63) Continuation of application No. PCT/DK2004/000656, filed on Sep. 29, 2004.

(30) Foreign Application Priority Data

Sep. 30, 2003 (DK) ..... 2003 01420

(51) Int. Cl.
*E06B 3/26* (2006.01)

(52) U.S. Cl. ..... 52/202; 52/217; 52/204.56; 49/505

(58) Field of Classification Search ..... 52/202, 52/203, 741.3, 786.1, 204.1, 211, 212, 215, 52/217, 204.54, 656.1, 127.2, 127.5, 127.6, 52/127.7, 127.8, 127.9, 127.11, 127.12, 213, 52/216; 160/369, 372; 49/505, 463, 504; 403/402

See application file for complete search history.

(56) References Cited

U.S. PATENT DOCUMENTS

| | | | | | |
|---|---|---|---|---|---|
| 794,469 | A | * | 7/1905 | Sherwood | 160/353 |
| 1,735,501 | A | * | 11/1929 | Hammill | 160/374 |
| 2,357,819 | A | * | 9/1944 | Greer | 160/351 |
| 2,624,405 | A | * | 1/1953 | Lynch | 160/353 |
| 2,714,944 | A | * | 8/1955 | Bongiovanni | 403/295 |
| 2,909,814 | A | * | 10/1959 | Schwartz | 52/309.3 |
| 3,451,153 | A | | 6/1969 | Dohanyos | 40/155 |
| 3,949,526 | A | * | 4/1976 | Sherlock et al. | 49/501 |

(Continued)

FOREIGN PATENT DOCUMENTS

| | | |
|---|---|---|
| CH | 596 428 | 3/1978 |

(Continued)

*Primary Examiner*—Richard E Chilcot, Jr.
*Assistant Examiner*—William V Gilbert
(74) *Attorney, Agent, or Firm*—Winston & Strawn LLP

(57) ABSTRACT

A temporary closure with a solid pane of for example glass framed in a quadrangular frame that includes four side members forming at least a part of each their side of the frame sides; eight corner members each telescopically connected to a side member and in pairs forming the four corners of the frame; four longitudinal mountings fastened on each their side member and each arranged to displaceably receive an area of the pane, and a fastener for fixing the pane in a wanted position in the frame. The frame includes at least one corner plate fastened on each of the corners of the frame and having sides that are longer than the extent of the adjacent mounting in the transverse direction. The temporary closure can be mounted and demounted quickly and easily, and its size can be changed to adapt to an opening. The temporary closure gives good security against the intrusion of unauthorized persons, as the solid pane cannot easily be broken through or cut open in the same way as panes consisting of a flexible plastic sheet.

16 Claims, 6 Drawing Sheets

U.S. PATENT DOCUMENTS 4,069,617 A * 1/1978 Koike ..... 49/428
4,296,587 A * 10/1981 Berdan ..... 52/786.1
4,445,563 A 5/1984 Meyeroff ..... 160/369
4,462,186 A 7/1984 Fuller ..... 49/463
4,702,051 A * 10/1987 Miller ..... 52/202
4,841,696 A 6/1989 Miller ..... 52/202
5,038,538 A * 8/1991 Rozon ..... 52/213
5,253,839 A * 10/1993 McClure ..... 248/354.1
5,485,705 A * 1/1996 Guillemet ..... 52/656.9
6,209,269 B1 * 4/2001 Valderrama ..... 52/171.3
6,588,334 B2 * 7/2003 Salisbury ..... 101/127.1
6,699,327 B2 * 3/2004 VanRossen ..... 118/505
6,863,112 B1 * 3/2005 Ayers et al. ..... 160/371

FOREIGN PATENT DOCUMENTS

EP 0 760 413 A1 3/1997

* cited by examiner

TEMPORARY CLOSURE

CROSS-REFERENCE TO RELATED APPLICATION

This application is a continuation of International application PCT/DK2004/000656 filed Sep. 29, 2004, the entire content of which is expressly incorporated herein by reference.

BACKGROUND ART

The invention relates to a temporary closure with a solid pane of e.g. glass framed in a quadrangular frame comprising four side members each forming at least a part of each their side of the frame, eight corner members each telescopically connected to a side member and in pairs forming the four corners of the frame, four longitudinal mountings mounted on each their side member and each arranged to displaceably receive an area of the pane, and means for fixing the pane in a wanted position in the frame.

In buildings that are being built, rebuilt or renovated, there are often a number of structural openings that must be closed temporarily to keep out rain, snow and wind, and during the cold period of the year furthermore keep the heat inside the building. The structural openings are moreover closed to prevent unauthorized persons from gaining access to the building via an open structural opening.

During the work on the building, the structural openings are conventionally closed by means of temporary windows or doors in form of a frame of e.g. wood with a sheet of e.g. plastic mounted in the frame. However, these temporary closures are relatively expensive to manufacture, as they have to be manufactured individually to be adapted to structural openings of different dimensions and tolerances. Another disadvantage is that unauthorized persons quickly and easily could gain entry to the building by merely cutting the sheet open with a knife.

From Swiss patent CH-596428 is known a temporary window with telescopically connected members. The size of the frame can therefore be changed and adapted individually to structural openings of different dimensions. The hole of the frame is closed by a covering. However, it is a problem that a specific covering must be made for each size. Thereby, the frame will be expensive to adapt in size. Moreover, the covering is easy to remove and/or cut open so that unauthorized persons can gain entry to the respective building without difficulty.

A similar temporary closure is known from U.S. Pat. No. 4,445,563. The size of this frame can also be adjusted. The hole of the frame is furthermore closed by means of a flexible sheet which easily is cut open. It is a problem that a specific sheet must be manufactured for each size.

Also, U.S. Pat. No. 4,841,696 describes a temporary window with a solid pane framed in an inner, fixed frame which in turn is displaceably mounted in an outer frame, the size of which can be changed to some degree. The outer frame is constructed of corners in form of two corner members fixedly connected to and forming a right angle with each other. The corner members are telescopically connected to four side members which can be displaced inwardly or outwardly in relation to the corner members so that the size of the outer frame can be reduced or increased, respectively. Four precompressed springs acting between the two frames permanently try to expand the outer frame.

A temporary window, which is slightly oversized in expanded state, is however chosen for a specific structural opening. During mounting the sides of the outer frame are then pressed in towards each other until the window is in the wanted position in the structural opening. Then the sides of the frame are released, and the sides are thereby automatically pressed out towards the inside faces of the structural opening under the influence of the precompressed spring powers of the springs. Demounting takes place by means of the same operation in reverse order.

The pane is automatically fixed in the frame by means of a complicated and expensive assembly of said springs and foam rubber strips which however only allow a change in size that is exactly enough to mount and demount the temporary window in the above manner. These operations are furthermore very hard and difficult to perform because it is necessary during this to press all four sides inwards at the same time. Thus, improvements in these types of temporary closures are desired and necessary.

SUMMARY OF THE INVENTION

The invention relates to a temporary closure that has a simple and inexpensive design. In addition, this temporary closure is easy to mount and demount. This temporary closure is adaptable in that its size can easily be changed within a larger interval than previously known constructions. Also, the temporary closure can be arranged to secure a structural opening against passage of unauthorized persons.

The novel and unique feature according to the invention, whereby this is achieved, is the fact that the frame comprises at least one corner plate having an extension portion that extends beyond the adjacent mounting(s) and over the pane. This is particularly achieved by configuring the corner plate to have sides that are longer than the extent of the adjacent mounting in the transverse direction, with the corner plate being fastened on a corner of the frame. At least two corner plates are preferred and most preferably four corner plates are used.

When the frame is to be mounted in a structural opening, its sides are made to abut on the inside faces of the structural opening and are fastened by e.g. screws. The solid pane is, as far as possible, placed in the middle of the frame and is fixed in this position. As can be seen, the temporary closure can thereby be mounted and demounted quickly and easily, and its size can, if so desired, be changed within a large interval without difficulty.

The temporary closure according to the invention gives a good security against the intrusion of unauthorized persons, as the solid pane cannot easily be broken or cut open in the same way as panes consisting of a flexible plastic sheet.

A simple, inexpensive and at the same time well-working structure is obtained if the side members and corner members of the frame are formed as side pipes and corner pipes telescopically engaging each other, the dimensions of the opening of the side members then mainly corresponding to the dimensions of the outer side of the corner members. To make the side and corner pipes able to telescope, a longitudinal slot can be made in each side pipe to displaceably receive an area of a corner plate, and this slot can advantageously be formed at the transition between the side pipe and the associated mounting, whereby the distance between the corner plate and the mountings will be minimum and the obtained sealing in the joint maximum.

In an advantageous embodiment which ensure good, reliable guiding of the pane in the mountings, each mounting can comprise two longitudinal mounting plates fastened on the associated side member with a mutual spacing mainly corresponding to the thickness of the pane. Each mounting can for example form a U, seen in cross section.

The means for fixing the pane in position comprises any type of fastener, including screws, bolts, nails rivets or other fasteners and are selected depending upon the type of pane that is used as well as the level or degree of permanence desired in the closure. The means for fixing the pane in the wanted position in the frame can, in one embodiment, consist of a nut on each corner plate and a screw in the nut. The pane is then fixed in the frame by fastening the screws. Depending on the hardness and nature of the pane, the screw can be made with a point or an elastomeric disc to fix the pane.

As the panes often are difficult to handle and put in place in a structural opening in e.g. apartment houses, the screws can advantageously be flap screws which can be manipulated quickly and easily without use of tools.

Alternatively, the pane can be positioned in the frame by means of screws or pins that are placed in an opening chosen among a number of openings located at mutual distances in the transverse direction of the respective mounting, whereby the possible displacement of the pane in the mounting is limited.

BRIEF DESCRIPTION OF THE DRAWINGS

The invention will be explained in greater details below, describing an only exemplary embodiment with reference to the drawing, in which.

DETAILED DESCRIPTION OF PREFERRED EMBODIMENTS

The temporary closure according to the invention is arranged to temporarily close empty structural openings that later are to be closed by ordinary windows or doors. It is especially structural openings in buildings which are being built, rebuilt and renovated that are possible in this connection. Generally, such structural openings, and thereby the windows or doors which are to be closed temporarily, have a quadrangular configuration.

Figure 1:
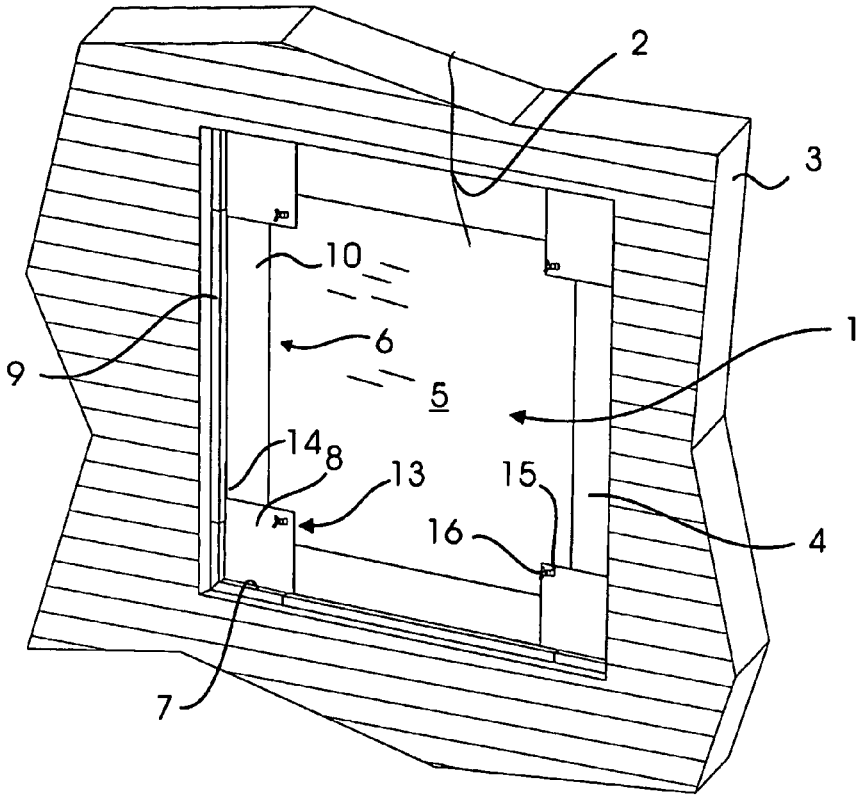
FIG. 1 is a perspective view of a temporary window according to the invention mounted in a structural opening in a fragmentarily shown wall.

The temporary closure 1 is shown in FIG. 1 inserted in a structural opening 2 in a fragmentarily shown wall 3. The window mainly consists of a frame 4 and a pane 5 of a solid material, for example plastic or glass. A circumferential strip (not shown) of an elastomeric material can optionally be mounted between the frame and the structural opening to obtain the desired imperviousness.

Figure 2:
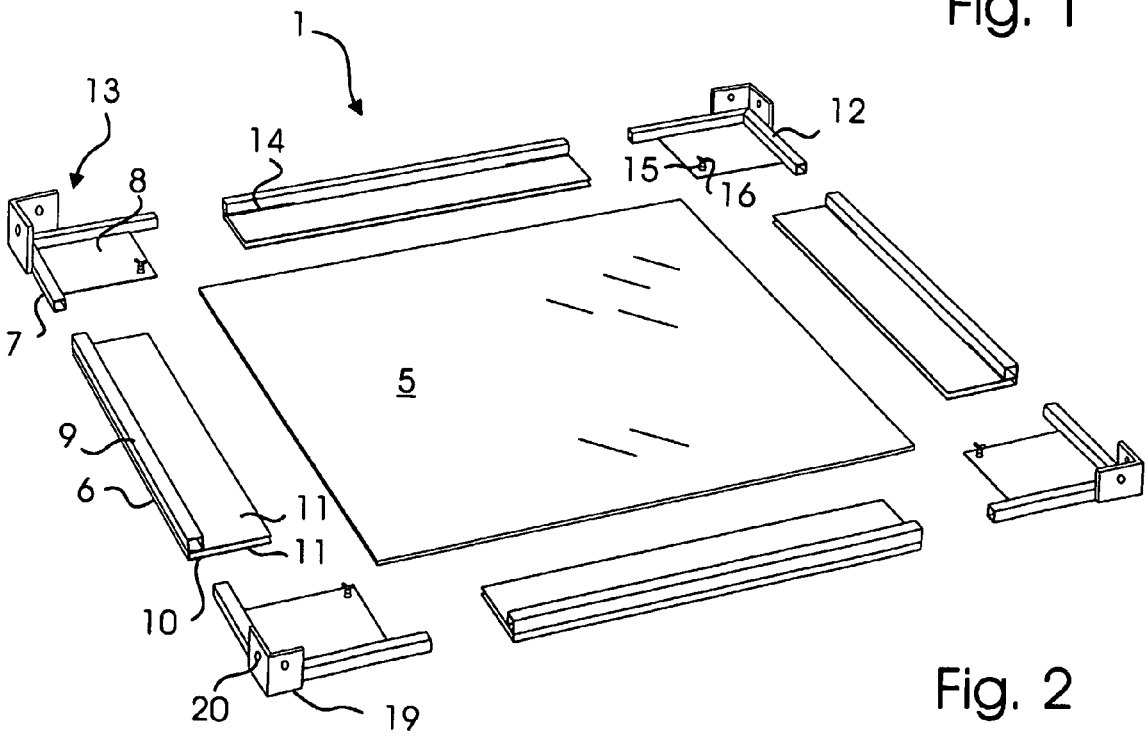
FIG. 2 is a perspective, exploded view of the window in FIG. 1.

FIG. 2 is an exploded view of the frame in FIG. 1, which comprises four side members 6, eight corner members 7, and four corner plates 8, which are quadrangular in the case shown.

Each side member consists, in the case shown, of a quadrangular side pipe 9 and a U-shaped mounting 10, which are joined to each other. Alternatively, the side member can be made in one piece of e.g. an extruded profile. The mounting has two longitudinal mounting plates 11 located with a mutual spacing that mainly corresponds to the thickness of the pane 5.

Each corner member consists, in the case shown, of a quadrangular corner pipe 12 having outside dimensions mainly corresponding to the inside dimensions of a side pipe. The corner pipe can therefore be pushed a distance inside the side pipe and be telescopically displaced in relation to this pipe. The corner members are joined two by two at a right angle and thereby, in pairs, form a corner 13 in the frame.

Figure 3:
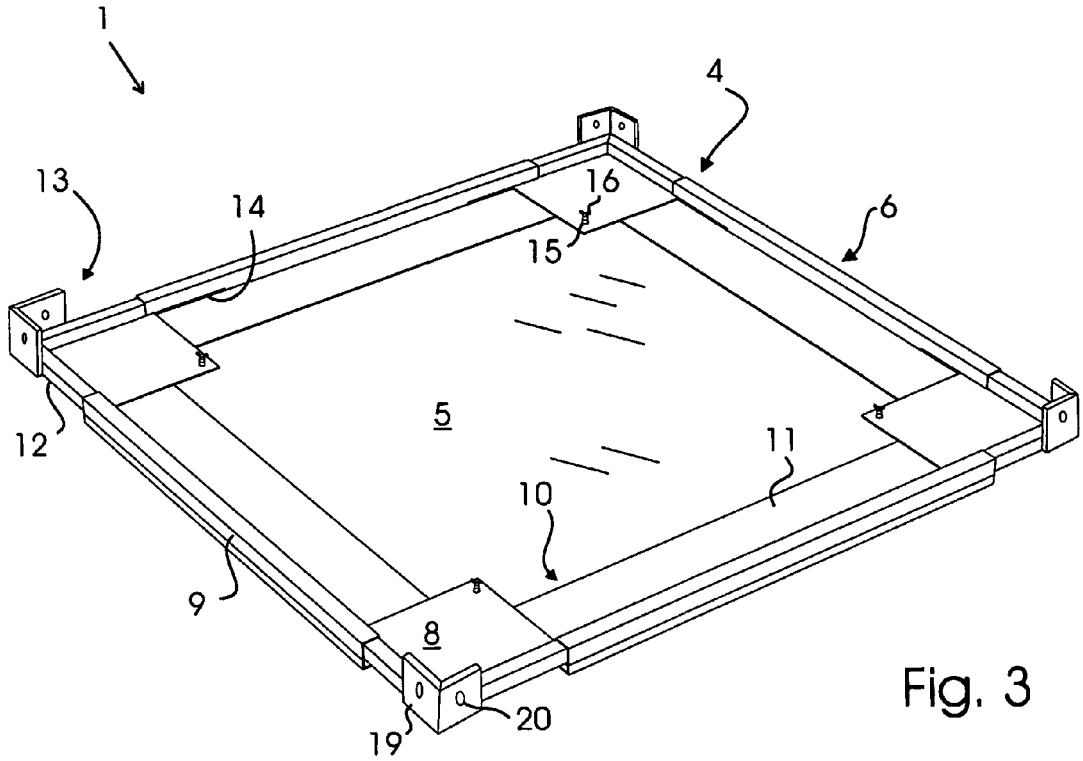
FIG. 3 is the window in FIG. 2 in assembled state.

In FIG. 3, the frame 4, together with the pane 5, is partly pushed into the four mountings 6. As the side pipes and corner pipes are telescopically displaceable in relation to each other, the size of the frame can be changed significantly. This is a considerable improvement over the known technique, as the window according to the invention now easily can be adapted to the often rather large tolerance variations in a rough structural opening just as the same window can be used for structural openings which are dimensioned with different sizes.

At the transition between the side pipe 9 and the mounting 11 a longitudinal slot 14 is formed to displaceably receive an area of the corner plate 8 and thereby allow the side and corner pipes 9 and 12 to telescope and thereby quickly and easily adapt the size of the frame 4 to the respective structural opening 2.

Figure 4:
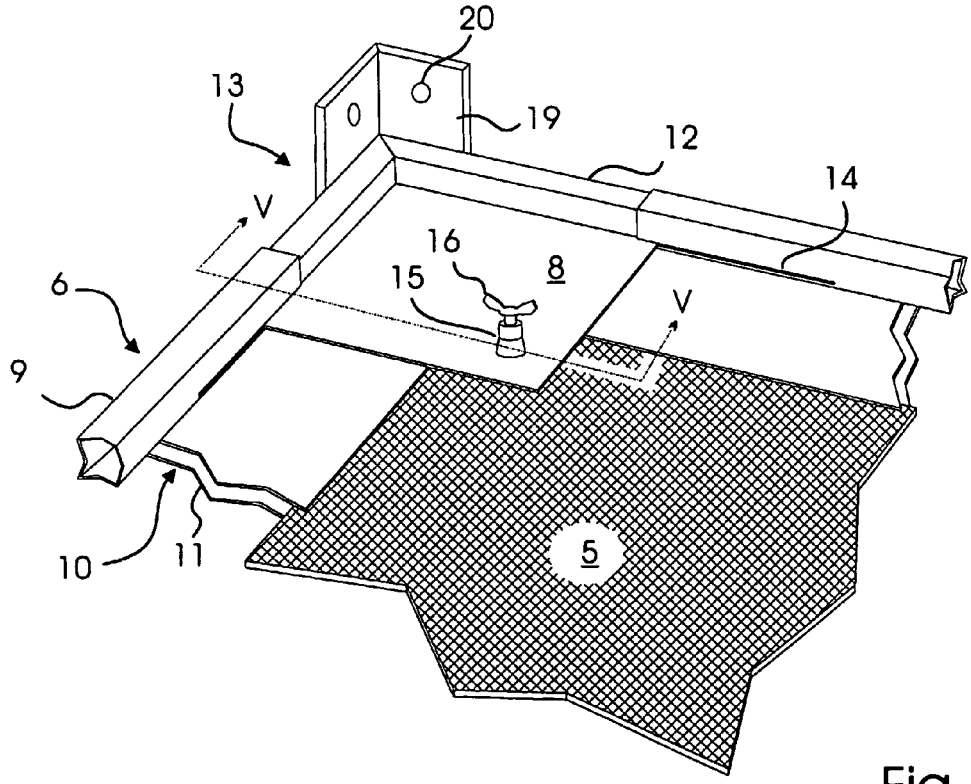
FIG. 4 is on a larger scale a fractional view of a corner of the window in FIGS. 1-3.

As seen best in FIG. 4, the sides of each corner plate have a greater dimensions to extend beyond the mounting and over the pane. Thus, the greater dimensions translate to a length that is greater than the extent of each mounting in the transverse direction. A corner of the corner plate 8 will thereby extend across a corner of the pane 5. On this location on the corner plate, the means for fixing the pane in position is located. As noted, this means comprises any type of fastener, including screws, bolts, nails rivets or other fasteners and are selected depending upon the type of pane that is used as well as the level or degree of permanence desired in the closure.

Figure 5:
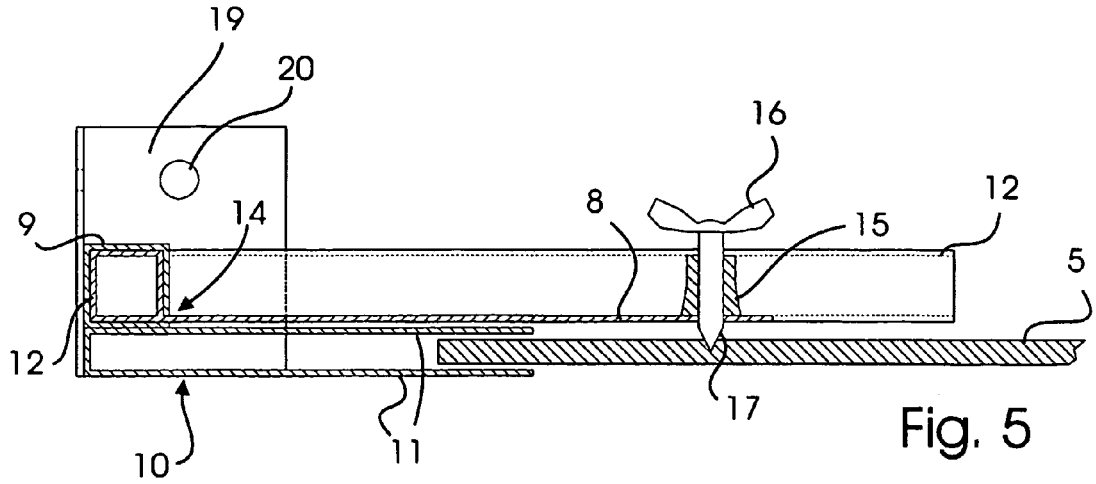
FIG. 5 is a sectional view taken along the line V-V of FIG. 4 of an embodiment of a closure according to the invention.
Figure 6:
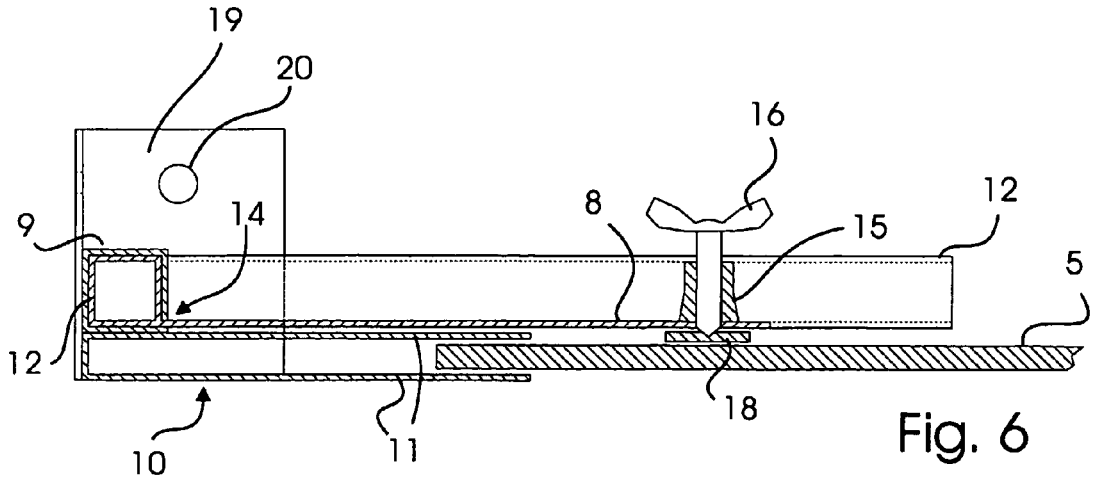
FIG. 6 shows the same in a second embodiment.

The fastener may be a nut 15 is mounted with a flap screw 16 to be tightened in towards the pane and thereby quickly and easily fix this pane in a relatively central position in the frame. FIG. 5 is a cross sectional view of one embodiment of the screw 16. In this case, the screw is made with a point 17 which is forced a little into the pane upon tightening. This embodiment of the screw is well suited to fix the pane in position in the frame if it is made of a relatively soft material, for example plastic. FIG. 6 is a cross sectional view of a second embodiment of the screw 16 which, in this case, is provided with a foot 18 of an elastomeric material, for example rubber. This embodiment of the screw is well suited to fix the pane in position in the frame if the pane is made of a relatively hard material, for example glass.

FIGS. 4, 5, and 6 also show a mounting fitting 19 that is fastened on the corner 13 of the frame. The mounting fitting is made with holes 20 for screws or bolts (not shown) to fasten the frame in the structural opening. It is noted that the frame also or instead can have mounting fittings fastened on the side members. By means of the mounting fittings several windows can also be mounted next to each other (not shown). Thereby the advantage is obtained in that a structural opening can be closed temporarily by means of a number of smaller windows if there is not a separate window which is large enough.

Figure 7:
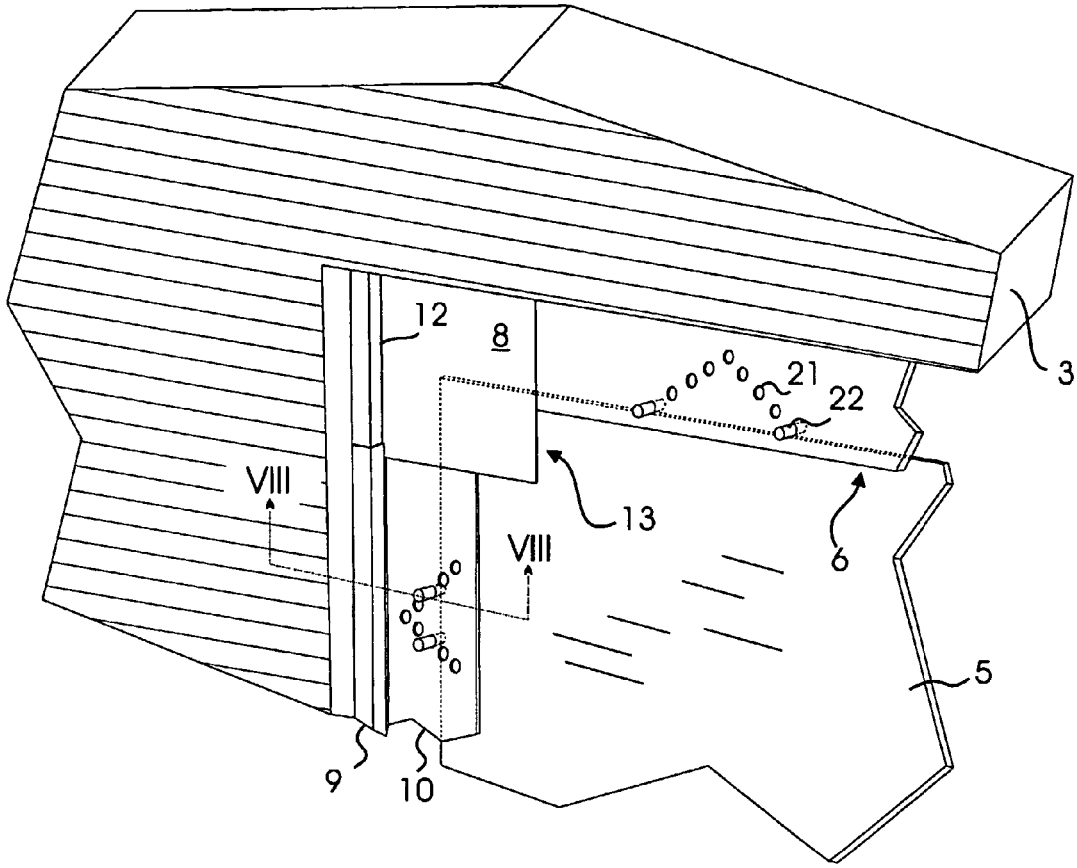
FIG. 7 is on a larger scale a fractional, perspective view of a third embodiment of the temporary closure according to the invention.
Figure 8:
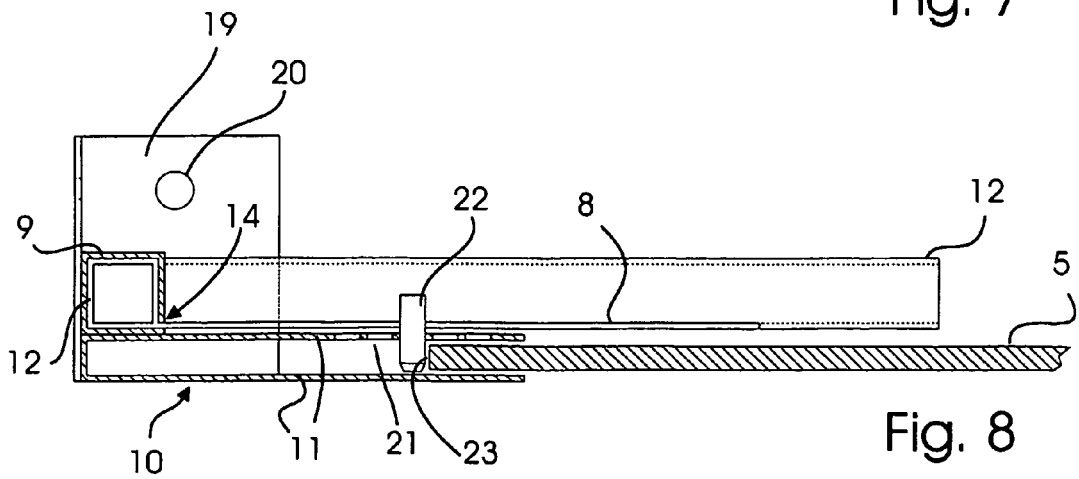
FIG. 8 is a sectional view taken along the line VIII-VIII of FIG. 7 of the third embodiment.

FIGS. 7 and 8 show an alternative way of fixing the pane in the frame. In this case a number of holes 21 are made in each mounting 10, the holes extend mainly transversely of the longitudinal direction of the mounting. A pin or screw 22 is inserted in one of the holes. This results in the pane 5 only being able to be pushed so far into the mounting that its edge 23 will abut the pin or screw 22. By an appropriate choice of holes in the mountings, the pane can thereby be fixed in a wanted position in the frame.

The window can be subjected to rain which must not penetrate to the rooms behind it. The frame is therefore assembled so that the outer mounting plate on the upper horizontal mounting overlaps the outer side of the two vertical mountings whereas the reverse is the case in the case of the lower horizontal mounting. The rain water will therefore run down into the lower horizontal mounting which continuously is drained of water via one or several drainage holes (not shown) made in the outer mounting plate of the lower mounting.

The size of the temporary window according to the invention can be changed considerably at the same time as it gives good security against unauthorized persons gaining entry to the respective building via the temporary window. The window furthermore has a simple design and can easily and quickly be adapted in size and mounted and demounted in a rough structural opening.

Figure 9:
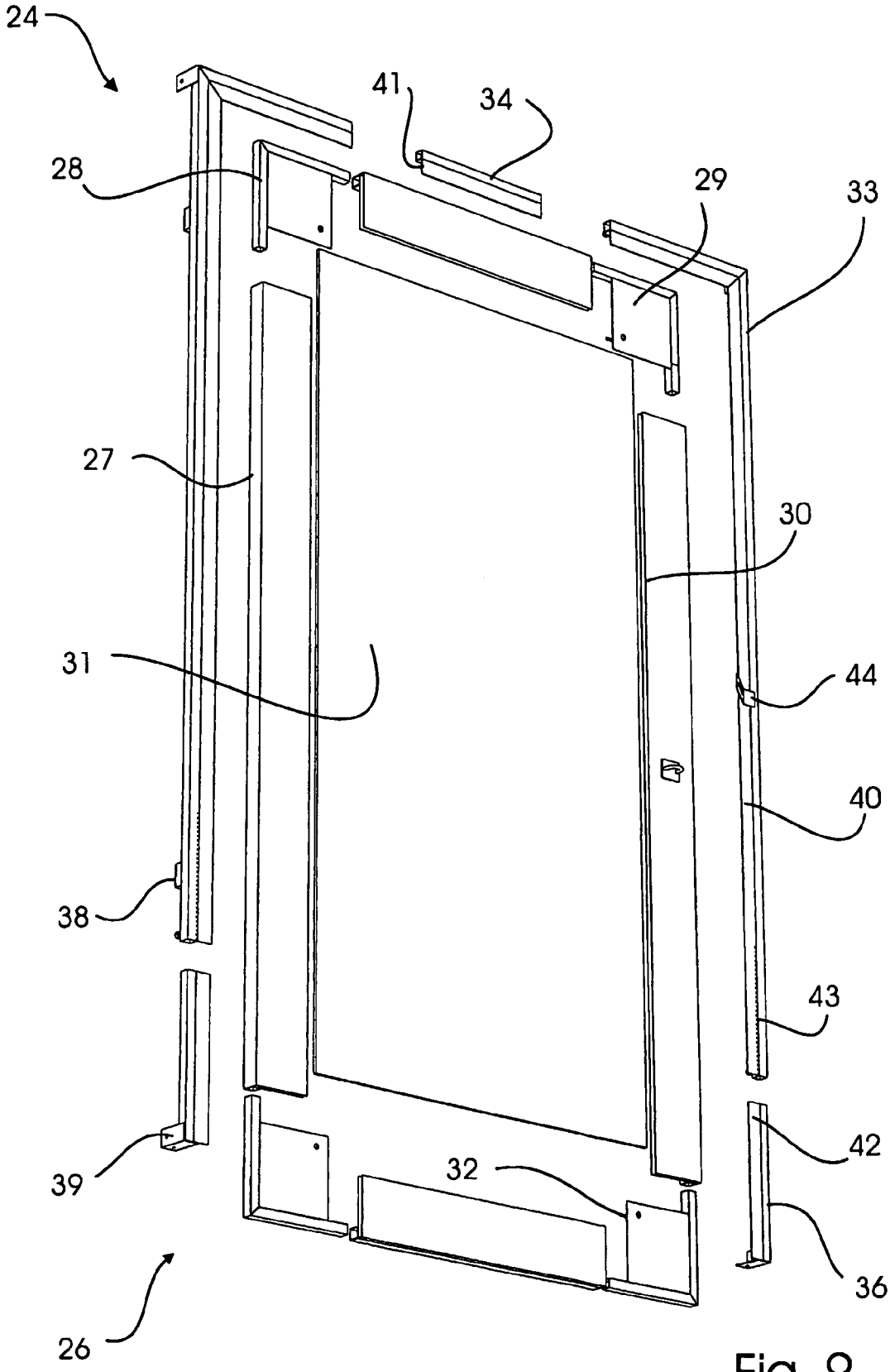
FIG. 9 is a perspective, exploded view of a fourth embodiment of the temporary closure according to the invention.
Figure 10:
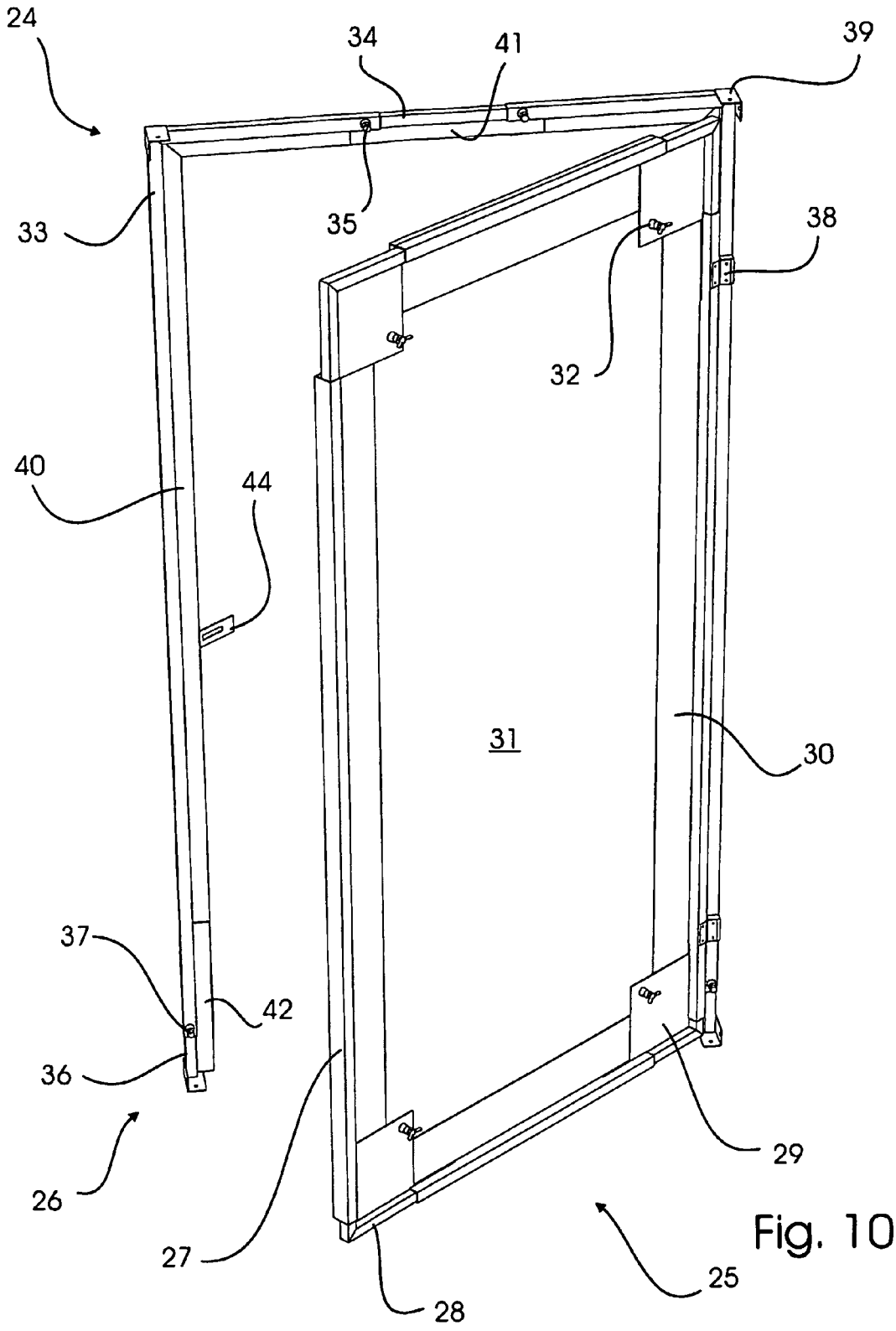
FIG. 10 is a view from the opposite side of the embodiment in FIG. 9 in assembled state.

As shown in FIGS. 9 and 10, the temporary closure can, in a fourth embodiment, be formed as a temporary door assembly 24 to fit in a door opening. The door assembly 24 comprises a door 25 and a doorframe 26. The door 25 is, among other things, made up of side members 27, corner members 28, and corner plates 29 joined in the same way as described above and with two mounting plates 30 provided on each side member 27 to secure a pane 31 of glass or another material, such as for example a wooden board or polycarbonate. And as described in previous embodiments, the pane is furthermore fixed by means of flap screws 32 formed on the corner plates 29.

The doorframe 26 comprises two angular frame members 33 joined via a telescopic member 34 by means of a first clamping nut 35 on each frame member 33. In the opposite end of each frame member, a frame base 36 is mounted which also is telescopically fastened to each frame member by means of a second clamping nut 37. Thus, the doorframe can, in mounted state, be adjusted in width by loosening the first clamping nuts 35 and displacing the two frame members 33 lengthwise of the telescopic member 34, and the doorframe can further be adjusted in height by loosening the other clamping nuts 37 and displacing the doorframe lengthwise of the frame bases 36.

The door is pivotally fastened in the doorframe by means of two hinges 38 mounted on one side of the assembly.

On one side of the assembly, the doorframe is furthermore formed with angle braces 39 on the corners of the two frame members and on the two frame bases. Screw holes are made in the angle braces to fasten the door assembly in the door opening. Additional angle braces (not shown) can advantageously be fastened along the frame members, for example at the centre of each frame member.

A projection 40 is made on each of the frame members 33 on the other side of the door assembly. The projection prevents insertion of e.g. a crowbar in the gap between the door and the projection and thus breaking open of the assembly.

For the projection to extend all the way around, respective second 41 and third projections 42 are furthermore made on the telescopic member and the frame bases, said projections being displaceably received, upon mounting, in respective slots 43 (shown in broken line) made in the frame members in the same way as described above with reference to FIG. 4.

On mounting in an opening, the door assembly is mounted with its second side facing outwardly. In this way, all mountings and exposed areas, such as hinges, will be inaccessible from the outside whereby unauthorized entry into a building which is being built is made considerably more difficult.

To lock a building the door assembly is made with known lock fittings 44 which easily are locked by means of a padlock (not shown).

In an alternative embodiment (not shown) the door can be made with a door handle and a built-in lock to lock the door in the doorframe. For this purpose any other known locking device can also be used to effectively prevent unauthorized persons to gain entry through the door assembly.

What is claimed is:

1. A temporary closure comprising a solid pane framed in a size-adjustable quadrangular frame that includes:

four side members, each of which forms at least a part of a side of the frame, eight corner members, each telescopically connecting a side member and in pairs forming a corner of the frame;

four longitudinal mountings, each of which is mounted on a side member and is arranged to displaceably receive part of the pane, at least one corner plate fastened on each corner of the frame and having an extension portion which extends beyond adjacent longitudinal mounting(s) over a free surface of the pane, said extension portion comprises means for fixing the pane member in a desired position in the frame, a longitudinal slot formed in each of the side members at the transition between the side member and the associated mounting, said slot being arranged to displaceably receive an area of a corner plate for facilitating adjustable movement between the side members and the corner members, means for detachably fastening the frame in a structural opening, whereby said frame may temporarily close the structural opening, and where the temporary closure is reusable in structural openings of different sizes.

2. The temporary closure of claim 1, wherein the extension portion of each corner plate comprises a side that is longer than the width of the adjacent mounting in the transverse direction.

3. The temporary closure of claim 1, wherein at least two corner plates are provided on the frame, each corner plate having an extension portion which extends beyond the adjacent mounting(s) and over the pane.

4. The temporary closure of claim 1, wherein four corner plates are provided on the frame, each corner plate having an extension portion which extends beyond the adjacent mounting(s) and over the pane.

5. The temporary closure of claim 1, wherein each mounting comprises two longitudinal mounting plates fastened on the associated side member with a mutual spacing mainly corresponding to the thickness of the pane.

6. The temporary closure of claim 1, wherein the means for fixing the pane in position comprises a fastener that is selected depending upon the type of pane that is used as well as the level or degree of permanence desired in the closure.

7. The temporary closure of claim 6, wherein the means for fixing the pane in a wanted position in the frame consists of at least one nut mounted on each corner plate and a screw mounted in the nut.

8. The temporary closure of claim 7, wherein the screw has a point for fixing into the pane.

9. The temporary closure of claim 7, which further comprises an elastomeric foot associated with the screw for holding the pane.

10. The temporary closure of claim 1, wherein the side members and corner members are formed as pipes for telescopically engaging each other.

11. The temporary closure of claim 1, wherein the side member include an opening, the dimensions of which mainly correspond to the dimensions of the outer side of the corner members.

12. The temporary closure of claim 1, wherein the means for detachably fastening the frame in a structural opening is a fastener.

13. The temporary closure of claim 12, wherein the fastener comprises a screw or bolt.

14. A temporary closure comprising a solid pane directly framed in a size-adjustable quadrangular frame that includes:

four tubular side members, each of which forms at least a part of a side of the frame and includes a longitudinal slot, eight tubular corner members, each telescopically connecting a side member and in pairs forming a corner of the frame, wherein the longitudinal slot facilitates adjustable movement between the side members and the corner members;

four longitudinal mountings, each of which is mounted on a side member and is arranged to displaceably receive part of the pane, at least one corner plate fastened on each corner of the frame and having an extension portion which extends beyond adjacent longitudinal mounting(s) and over the pane, means for fixing the pane member in a desired position in the frame, wherein the temporary closure further comprises a size-adjustable doorframe that includes:

two frame members each formed with a perpendicular bending therebetween, a telescopic member for displaceably and telescopically connecting the two frame members to each other, two frame bases displaceably and telescopically connecting its respective frame member, and at least one hinge partly mounted on one of the two frame members, partly on one of the four side members, providing a pivotal fastening of the doorframe to the quadrangular frame;

wherein the two frame bases are fastened to each their frame member.

15. The temporary closure of claim 14, further comprising:

angle braces for detachably fastening the two frame members and the two frame bases in a structural opening.

16. The temporary closure of claim 14, further comprising:

protection projections on the two frame members, the telescopic member, and the two frame bases, whereby the projections protect against breaking the temporary closure.

* * * * *